US009108432B2

(12) United States Patent
Sohgawa

(10) Patent No.: US 9,108,432 B2
(45) Date of Patent: Aug. 18, 2015

(54) IMAGE FORMING APPARATUS, IMAGE FORMING METHOD, AND COMPUTER-READABLE STORAGE MEDIUM TO FORM A IMAGE ON A THREE DIMENSIONAL OBJECT

(71) Applicant: Norimasa Sohgawa, Kanagawa (JP)

(72) Inventor: Norimasa Sohgawa, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/251,731

(22) Filed: Apr. 14, 2014

(65) Prior Publication Data

US 2014/0313254 A1 Oct. 23, 2014

(30) Foreign Application Priority Data

Apr. 23, 2013 (JP) ..... 2013-090441
Mar. 4, 2014 (JP) ..... 2014-042006

(51) Int. Cl.
*B41J 29/38* (2006.01)
*B41J 3/407* (2006.01)

(52) U.S. Cl.
CPC ..... *B41J 3/4073* (2013.01)

(58) Field of Classification Search
CPC ..... B41J 3/4073
USPC ..... 347/14; 118/681; 101/35
See application file for complete search history.

(56) References Cited

U.S. PATENT DOCUMENTS 5,429,682 A * 7/1995 Harlow et al. ..... 118/681
2001/0017085 A1* 8/2001 Kubo et al. ..... 101/35

FOREIGN PATENT DOCUMENTS

JP 2005-138501 6/2005
JP 207106049 * 4/2007
JP 4603457 12/2010

* cited by examiner

*Primary Examiner* — Julian Huffman
*Assistant Examiner* — Carlos A Martinez
(74) *Attorney, Agent, or Firm* — Oblon, McClelland, Maier & Neustadt, L.L.P.

(57) ABSTRACT

An image forming apparatus includes a shape information acquisition unit configured to acquire shape information indicating a shape of a three-dimensional object on which an image forming process is to be performed; a surface determination unit configured to determine a plurality of surfaces from which the three-dimensional object is constructed, based on the shape information; and an output image information generation unit configured to generate surface image information and join region image information. The surface image information is information on images to be formed on the respective surfaces. Each image is of a region obtained by cutting an end of the corresponding surface by a predetermined amount. The join region image information is information on an image to be formed on a join region between the adjacent surfaces.

10 Claims, 12 Drawing Sheets

IMAGE FORMING APPARATUS, IMAGE FORMING METHOD, AND COMPUTER-READABLE STORAGE MEDIUM TO FORM A IMAGE ON A THREE DIMENSIONAL OBJECT

CROSS-REFERENCE TO RELATED APPLICATION

The present application claims priority to and incorporates by reference the entire contents of Japanese Patent Application No. 2013-090441 filed in Japan on Apr. 23, 2013 and Japanese Patent Application No. 2014-042006 filed in Japan on Mar. 4, 2014.

BACKGROUND OF THE INVENTION

1. Field of the Invention

The present invention relates to an image forming apparatus, an image forming method, and a computer-readable storage medium.

2. Description of the Related Art

Recent years have seen a wider use of image forming apparatuses that form images on a three-dimensional object by ejecting ink thereto. A method has been disclosed, for example, in Japanese Patent Application Laid-open No. 2007-106049, in which such an image forming apparatus forms different images adjacent to each other on a curved surface of a three-dimensional object. According to this method, ink concentrations for the respective images are thinner toward the boundary of surfaces on which the images are formed so that the boundary of the surfaces will not be thick due to an overlap of the images, whereby the images formed adjacent to each other are joined smoothly.

When the image forming apparatus described above ejects ink to each surface of a three-dimensional object, it fails to eject sufficient ink on the end portion of each surface in some cases. This may cause a blank portion along a join between surfaces of the three-dimensional object. When the image forming apparatus ejects sufficient ink to the end portion of each surface in order not to cause such a blank portion along a join between surfaces, the ink may drip off from the end portion of a surface, thereby causing dribbling of ink in some cases. The conventional technology described in Japanese Patent Application Laid-open No. 2007-106049 fails to consider the problems of a blank portion along a join between surfaces, or dribbling of ink.

Therefore, there is a need to prevent a blank portion from occurring along a join between surfaces of a three-dimensional object without causing dribbling of ink.

SUMMARY OF THE INVENTION

It is an object of the present invention to at least partially solve the problems in the conventional technology.

According to an embodiment, there is provided an image forming apparatus that includes a shape information acquisition unit configured to acquire shape information indicating a shape of a three-dimensional object on which an image forming process is to be performed; a surface determination unit configured to determine a plurality of surfaces from which the three-dimensional object is constructed, based on the shape information; and an output image information generation unit configured to generate surface image information and join region image information. The surface image information is information on images to be formed on the respective surfaces. Each image is of a region obtained by cutting an end of the corresponding surface by a predetermined amount. The join region image information is information on an image to be formed on a join region between the adjacent surfaces.

According to another embodiment, there is provided an image forming method that includes acquiring shape information indicating a shape of a three-dimensional object on which an image forming process is to be performed; determining a plurality of surfaces from which the three-dimensional object is constructed, based on the shape information; and generating surface image information and join region image information, the surface image information being information on images to be formed on the respective surfaces, each image being of a region obtained by cutting an end of the corresponding surface by a predetermined amount, the join region image information being information on an image to be formed on a join region between the adjacent surfaces.

According to still another embodiment, there is provided a non-transitory computer-readable storage medium with an executable program stored thereon and executed by a computer. The program instructs the computer to perform: acquiring shape information indicating a shape of a three-dimensional object on which an image forming process is to be performed; determining a plurality of surfaces from which the three-dimensional object is constructed, based on the shape information; and generating surface image information and join region image information, the surface image information being information on images to be formed on the respective surfaces, each image being of a region obtained by cutting an end of the corresponding surface by a predetermined amount, the join region image information being information on an image to be formed on a join region between the adjacent surfaces.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

An embodiment according to the present invention is now described in detail with reference to the accompanying drawings. In the present embodiment, an image forming apparatus that forms images on a three-dimensional object by ejecting ink thereto prevents a blank portion from occurring along a join between surfaces of the three-dimensional object without causing dribbling of ink. In the present embodiment, the term "ink" is not limited to "ink" in a narrow sense, but is used as a generic term for any types of liquid, such as recording liquid, or fixing solution, usable for image formation.

Figure 1:
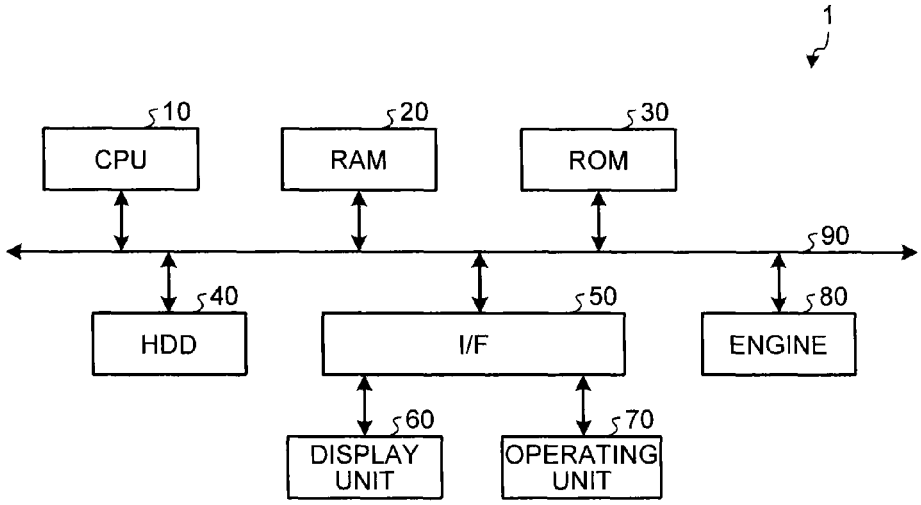
FIG. 1 is a schematic block diagram illustrating a hardware configuration of an image forming apparatus according to an embodiment.

FIG. 1 is a block diagram illustrating a hardware configuration of an image forming apparatus 1 that is an information processing apparatus according to the present embodiment. As illustrated in FIG. 1, the image forming apparatus 1 according to the present embodiment has the same configuration as that of an information processing terminal such as a server or personal computer (PC) generally used, and includes an engine that performs image formation. In other words, the image forming apparatus 1 according to the present embodiment includes a central processing unit (CPU) 10, a random access memory (RAM) 20, a read only memory (ROM) 30, a hard disk drive (HDD) 40, an I/F 50, and an engine 80 that are connected to one another via a bus 90. A display unit 60 and an operating unit 70 are connected to the I/F 50.

The CPU 10 is an arithmetic unit, and controls the entire operation of the image forming apparatus 1. The RAM 20 is a volatile storage medium that can read and write information rapidly, and is used by the CPU 10 as a working area to process information. The ROM 30 is a read-only non-volatile storage medium and stores therein computer programs such as firmware. The HDD 40 is a non-volatile storage medium that can read and write information and stores therein computer programs such as an operating system (OS), various control programs, and application programs.

The I/F 50 connects the bus 90 and various types of hardware and a network and controls the connection. The display unit 60 is a visual user interface for a user to check a status of the image forming apparatus 1. The operating unit 70 is a user interface, such as a keyboard and a mouse, for the user to input information to the image forming apparatus 1. The engine 80 is hardware that actually performs image forming in the image forming apparatus 1, and includes a droplet ejecting head (droplet ejecting unit) that ejects ink droplets, and a mounting table on which a three-dimensional object is mounted so that the mounted three-dimensional object is tilted or moved in accordance with a positional relation between a surface of the three-dimensional object on which an image is formed and the droplet ejecting head.

In the hardware configuration described above, a computer program stored in the ROM 30, the HDD 40, or a storage medium such as an optical disc (not illustrated) is loaded on the RAM 20, and the CPU 10 performs calculation according to the computer program to configure a software control unit. The thus-configured software control unit and the hardware are combined to configure functional blocks that implement functions of the image forming apparatus 1 according to the present embodiment.

Figure 2:
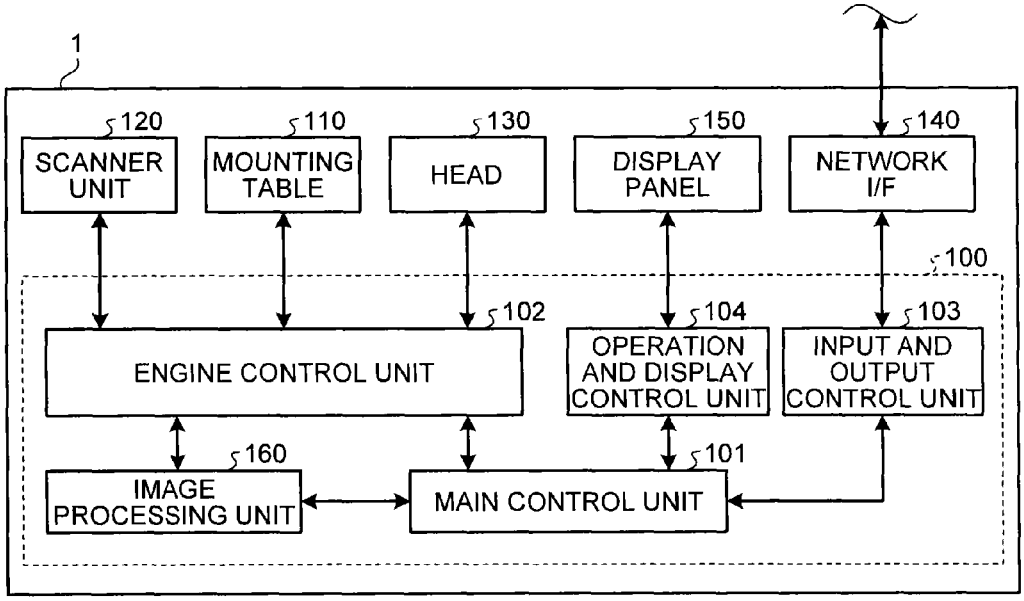
FIG. 2 is a block diagram illustrating a functional configuration of the image forming apparatus according to the embodiment.

Next, described is a functional configuration of the image forming apparatus 1 according to the present embodiment. FIG. 2 is a block diagram illustrating the functional configuration of the image forming apparatus 1 according to the present embodiment. As illustrated in FIG. 2, the image forming apparatus 1 according to the present embodiment includes a controller 100, a mounting table 110, a scanner unit 120, a droplet ejecting head 130 (hereinafter referred to as a "head 130"), a network I/F 140, and a display panel 150.

The controller 100 includes a main control unit 101, an engine control unit 102, an input and output control unit 103, an operation and display control unit 104, and an image processing unit 160. The image forming apparatus 1 according to the present embodiment is thus configured to perform an image forming process by ejecting ink to a three-dimensional object.

The network I/F 140 is an interface for the image forming apparatus 1 to communicate with other apparatuses via a network, and is an Ethernet (registered trademark) interface or a universal serial bus (USB) interface. The display panel 150 is an output interface that displays a state of the image forming apparatus 1 visually, and also is an input interface (operating unit) that is a touch panel on which the user directly operates the image forming apparatus 1 or inputs information to the image forming apparatus 1.

The controller 100 is configured by a combination of software and hardware. Specifically, a control program such as firmware stored in a non-volatile storage medium such as the ROM 30 and the HDD 40 is loaded on the RAM 20, so that the CPU 10 performs calculation in accordance with the control program to configure the software control unit. The thus-configured software control unit and hardware such as an integrated circuit constitute the controller 100. The controller 100 functions as a control unit that controls the entire image forming apparatus 1.

The main control unit 101 controls the units included in the controller 100, and gives instructions to the units of the controller 100. The engine control unit 102 controls or drives the mounting table 110, the scanner unit 120, and the head 130.

The input and output control unit 103 inputs signals and instructions received via the network I/F 140 to the main control unit 101. The main control unit 101 also controls the input and output control unit 103 to access other apparatuses via the network I/F 140.

The image processing unit 160 generates drawing information on the basis of print information contained in an input print job and input shape information on a three-dimensional object under the control of the main control unit 101. The drawing information is output image information on images to be formed on a three-dimensional object by the head 130 by performing an image forming operation. The print information contained in the print job is image information that is converted by a printer driver installed on an information processing apparatus such as a PC into a format that is recognizable by the image forming apparatus 1. The shape information on a three-dimensional object is information indicating the shape of a three-dimensional object recognized by the scanner unit 120 that is, for example, a three-dimensional laser scanner, and information indicating, for example, coordinates of points constituting the three-dimensional object, presence or absence of line segments connecting the points, and presence or absence of surfaces defined by the line segments. The operation and display control unit 104 displays information on the display panel 150 or notifies the main control unit 101 of information input via the display panel 150.

Figure 3:
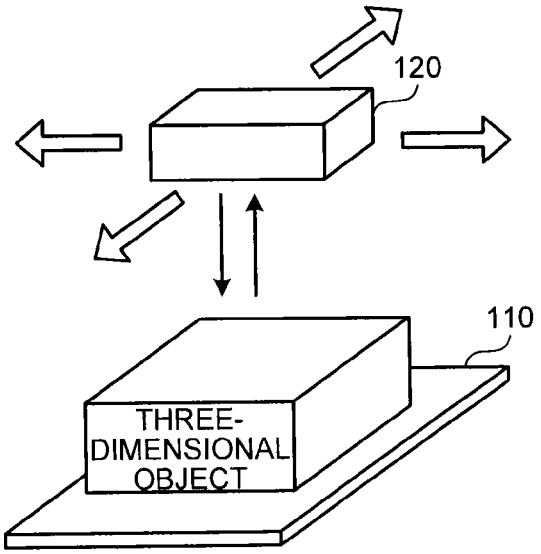
FIG. 3 is a diagram illustrating how a scanner unit according to the embodiment of the present invention recognizes a shape of a three-dimensional object.
Figure 4:
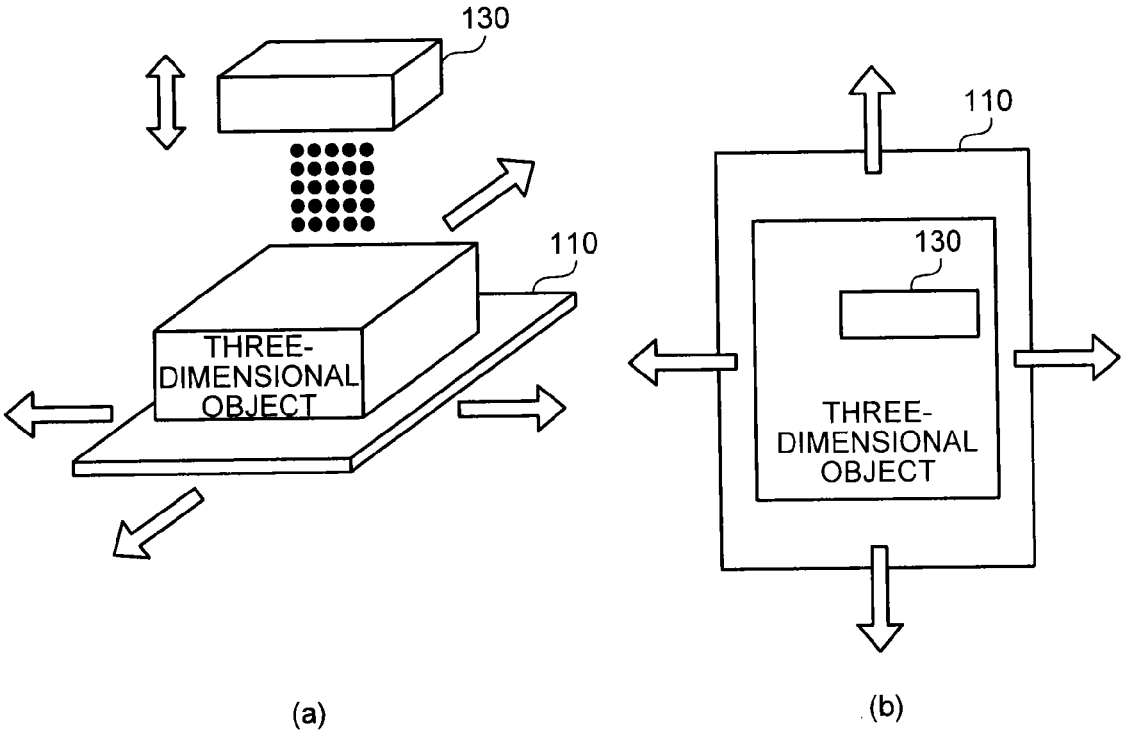
FIG. 4 illustrates how a head according to the embodiment of the present invention performs an image forming process on the three-dimensional object.

Next, an image forming operation on a three-dimensional object is specifically described with reference to FIGS. 3 and 4. FIG. 3 is a diagram illustrating an example of how the scanner unit 120 recognizes the shape of a three-dimensional object mounted on the mounting table 110. In FIG. 4, (a) is a diagram illustrating an example of how the head 130 performs the image forming process on the three-dimensional object mounted on the mounting table 110. In FIG. 4, (b) is a plan view of a state illustrated in (a) of FIG. 4 seen from above.

The input and output control unit 103 receives a print job via the network I/F 140. The input and output control unit 103 transfers the received print job to the main control unit 101. When receiving the print job, the main control unit 101 acquires shape information on the three-dimensional object acquired by the scanner unit 120 via the engine control unit 102. The engine control unit 102 controls the scanner unit 120 to move back and forth and left and right, and to irradiate the three-dimensional object on the mounting table 110 with laser, so that the scanner unit 120 measures, for example, the distance to the three-dimensional object and angles to acquire shape information.

The present embodiment describes an example in which shape information on a three-dimensional object is acquired by the non-contact scanner unit 120 such as a three-dimensional laser scanner that measures an object without contacting it. The shape information may be acquired by a contact scanner unit 120 that measures an object by contacting it. The shape information may also be acquired from three-dimensional computer aided design (CAD) data input by the user instead of measurement by the scanner unit 120.

When acquiring the shape information on the three-dimensional object, the main control unit 101 controls the image processing unit 160 to generate drawing information on the basis of print information contained in the print job and the acquired shape information on the three-dimensional object. After the image processing unit 160 generates the drawing information, the engine control unit 102 controls the mounting table 110 and the head 130 on the basis of the generated drawing information to perform the image forming process on the three-dimensional object.

Specifically, as illustrated in (b) of FIG. 4, the engine control unit 102 moves the mounting table 110 so that a surface of the three-dimensional object on which the image forming process is performed and a nozzle surface of the head 130 from which ink is ejected are positioned parallel to each other to perform the image forming process on each surface of the three-dimensional object. The engine control unit 102 moves the mounting table 110 back and forth and left and right to perform the image forming process on the three-dimensional object mounted on the mounting table 110 by applying ink ejected from the head 130 thereto. When the image forming process is performed on another surface of the three-dimensional object, the engine control unit 102 tilts the mounting table 110 so that the other surface and the nozzle surface of the head 130 from which ink is ejected are positioned parallel to each other, and moves the mounting table 110 in the same manner as described above to perform the image forming process. The engine control unit 102 may move the head 130, instead of the mounting table 110, so that the nozzle surface of the head 130 and a surface of the three-dimensional object on which the image forming process is performed are positioned parallel to each other.

Figure 5:
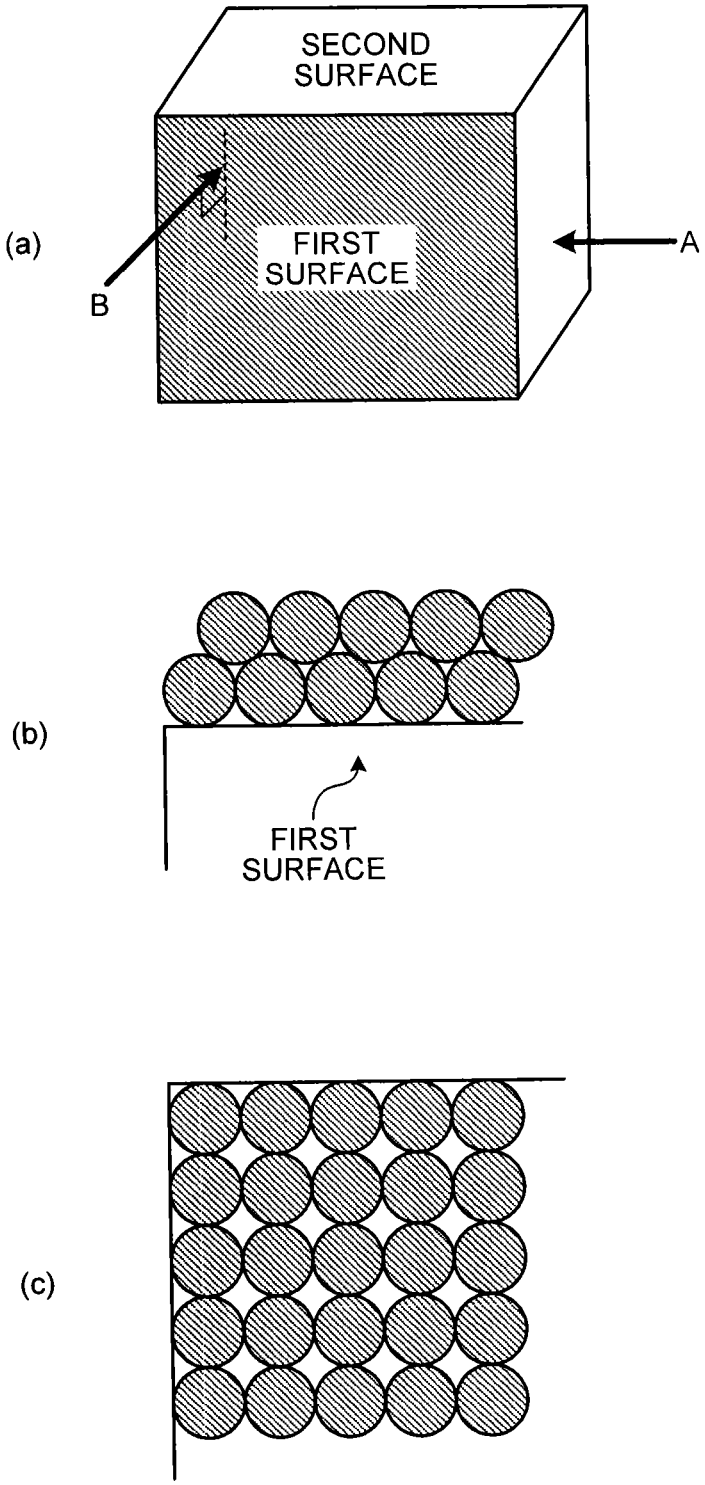
FIG. 5 illustrates a conventional image forming process on a three-dimensional object.
Figure 6:
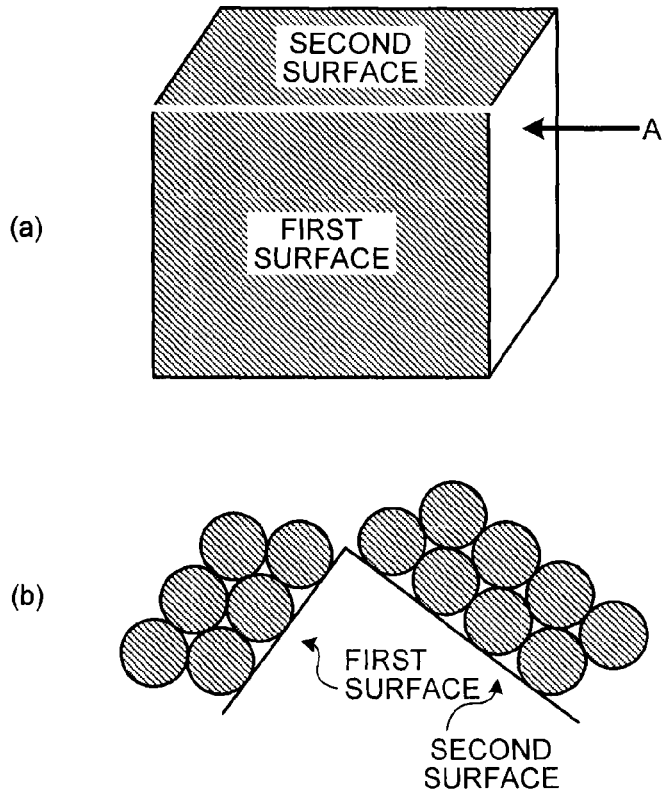
FIG. 6 illustrates the conventional image forming process on the three-dimensional object.

The following describes a conventional image forming process on a three-dimensional object performed by an image forming apparatus. FIGS. 5 and 6 are diagrams illustrating an example of how an image forming process is performed on a three-dimensional object. As illustrated in (a) of FIG. 5, the image forming process is first performed on a first surface and ink is applied thereto. In FIG. 5, (b) is an enlarged diagram illustrating the first surface of the three-dimensional object seen from the direction indicated by A in (a) of FIG. 5. In FIG. 5, (c) is an enlarged diagram illustrating the first surface of the three-dimensional object seen from the direction indicated by B in (a) of FIG. 5, that is, from the direction perpendicular to the first surface. As illustrated in (b) and (c) of FIG. 5, a plurality of ink droplets illustrated by hatched circles adhere to the first surface. As illustrated in (b) of FIG. 5, the coating on the first surface becomes thicker as more ink droplets are deposited.

As illustrated in (a) of FIG. 6, the image forming process is then performed on a second surface of the three-dimensional object and ink is applied thereto. In FIG. 6, (b) is an enlarged diagram illustrating the first and the second surfaces of the three-dimensional object seen from the direction indicated by A in (a) of FIG. 6. As illustrated in (b) of FIG. 6, a plurality of ink droplets adhere to the first and the second surfaces, but no ink droplet adheres to the edge (join) formed by the first and the second surfaces. This causes a blank portion along the join between the first and the second surfaces as illustrated in (a) of FIG. 6.

If ink is sufficiently applied to the very end of each surface in order not to cause a blank portion along a join between surfaces, dribbling of ink may occur due to ink dripping out from the end of each surface. If additional ink is ejected to the join between surfaces to eliminate the blank portion, an amount of ink for an area of the blank portion is so large that dribbling of ink may occur.

Figure 7:
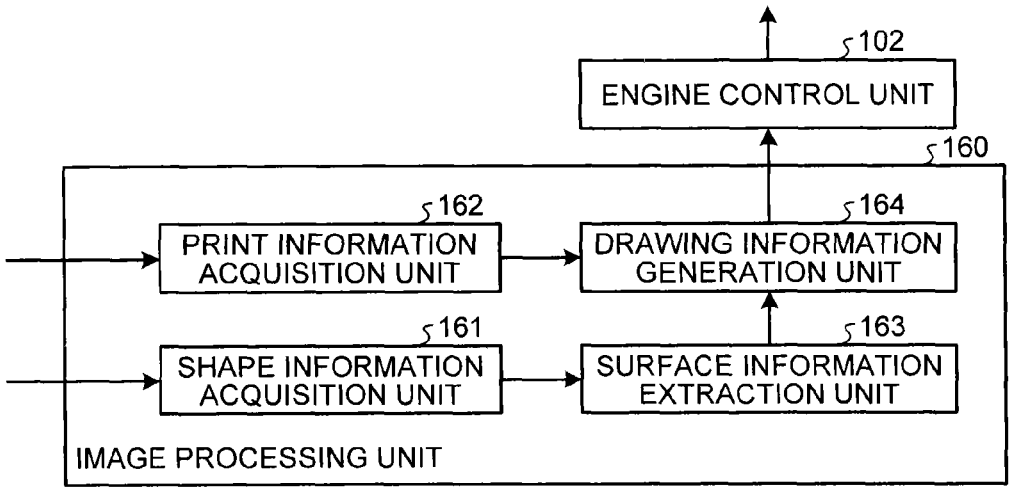
FIG. 7 is a block diagram illustrating a functional configuration of an image processing unit according to the embodiment.

The present embodiment provides an image forming apparatus that prevents a blank portion from occurring along a join between surfaces of a three-dimensional object without causing dribbling of ink in such cases described above. The following describes processing performed by the image forming apparatus 1 according to the present embodiment. FIG. 7 is a diagram illustrating an example of a functional configuration of the image processing unit 160, and the engine control unit 102 according to the present embodiment. As illustrated in FIG. 7, the image processing unit 160 includes a shape information acquisition unit 161, a print information acquisition unit 162, a surface information extraction unit 163, and a drawing information generation unit 164.

The shape information acquisition unit 161 acquires shape information on a three-dimensional object measured by the scanner unit 120, and outputs the shape information to the surface information extraction unit 163. The print information acquisition unit 162 acquires print information contained in an input print job, and outputs the print information to the drawing information generation unit 164.

The surface information extraction unit 163 extracts surface information indicating positions, sizes, and shapes of the surfaces of the three-dimensional object on the basis of the shape information input from the shape information acquisition unit 161, and outputs the surface information to the drawing information generation unit 164. Specifically, when a region extracted from, for example, coordinates of points constituting the three-dimensional object indicated by the shape information is larger than a minimum printing region of the head 130, the surface information extraction unit 163 extracts the region as a surface.

When an interior angle formed by extracted surfaces is equal to or smaller than a predetermined angle (120 degrees, for example), the surface information extraction unit 163 extracts these surfaces as surface information (such as the first and the second surfaces illustrated in (a) of FIG. 6) on which the image forming process is performed separately. When an interior angle formed by extracted surfaces is larger than a predetermined angle, the surface information extraction unit 163 extracts these surfaces as one piece of surface information because these surfaces can be considered to be a smoothly curved surface. In other words, the surface information extraction unit 163 functions as a surface determination unit that determines surfaces constituting a three-dimensional object on the basis of shape information on the three-dimensional object.

The drawing information generation unit 164 generates drawing information on the basis of the surface information input from the surface information extraction unit 163 and the print information input from the print information acquisition unit 162, and outputs the drawing information to the engine control unit 102. When the surface information input from the surface information extraction unit 163 indicates a plurality of surfaces of the three-dimensional object, there is a join between surfaces. The drawing information generation unit 164 thus generates drawing information for join processing according to the present embodiment in order to prevent a blank portion along a join or dribbling of ink as described above.

Specifically, for example, the drawing information generation unit 164 generates drawing information (surface image information) for a surface containing image information partially cut by a predetermined amount (such as by one dot of ink droplets) from an end of each surface forming a join, and generates drawing information (join region image information) for a join on the basis of image information on a cutoff portion from an end of each surface forming a join. When surface information input from the surface information extraction unit 163 indicates one surface (that is, there is no join on the surface), the drawing information generation unit 164 generates drawing information on the basis of input print information in a conventional manner (details will be described later with reference to FIG. 8). In other words, the drawing information generation unit 164 functions as an output image information generation unit that generates the surface image information and the join region image information described above.

A join represents a region (join region) joining two surfaces extracted. As illustrated in (a) of FIG. 6, when two surfaces are plane, a join is a line. A surface may not necessarily be plane, but may be a curved surface. A join may be plane or a curved surface. For example, when two surfaces of a three-dimensional object are joined to form a rounded-edge-like shape and are extracted, the join between the two surfaces has a curving shape.

Figure 8:
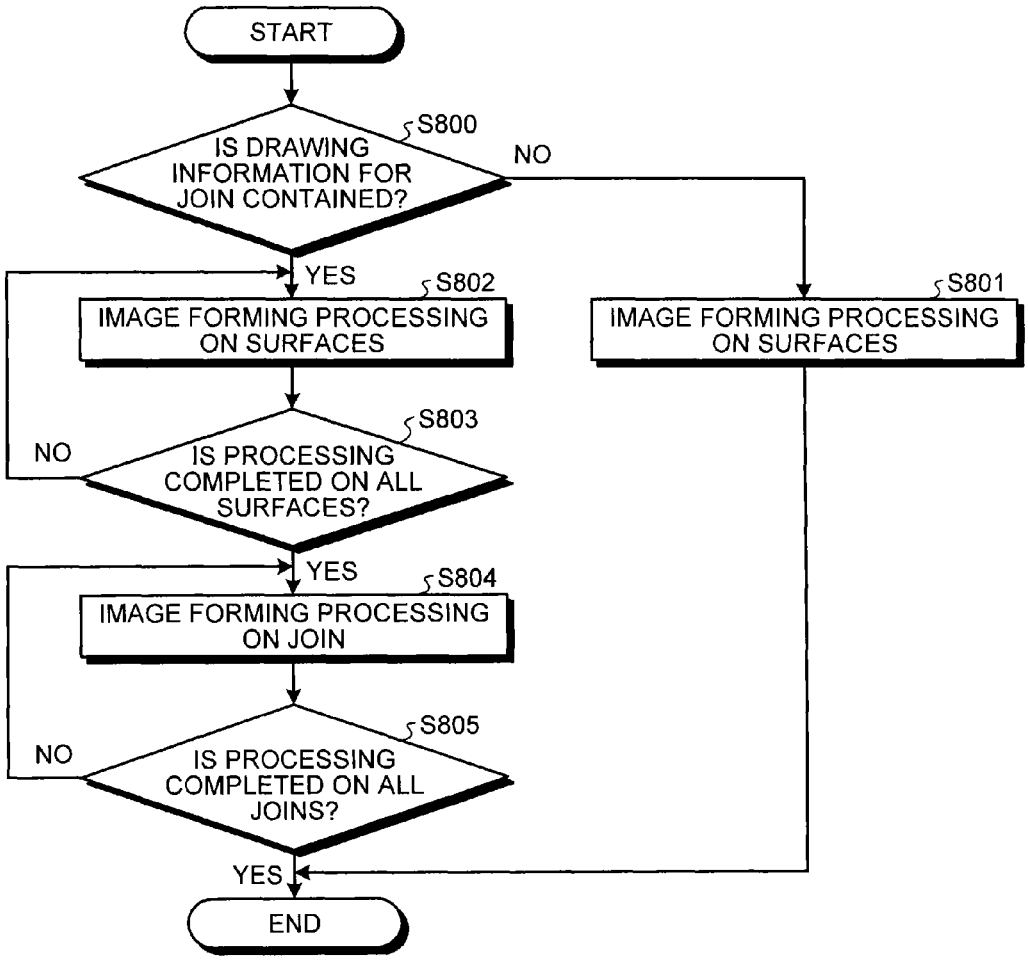
FIG. 8 is a flowchart illustrating an image forming process according to the embodiment.

The engine control unit 102 controls the mounting table 110 and the head 130 to perform the image forming process on the three-dimensional object mounted on the mounting table 110 on the basis of drawing information input from the drawing information generation unit 164. In other words, the engine control unit 102 functions as an image forming control unit that causes the head 130 to perform the image forming process. FIG. 8 is a flowchart illustrating an example of the image forming process performed by the engine control unit 102. As illustrated in FIG. 8, when the engine control unit 102 receives drawing information from the drawing information generation unit 164, the engine control unit 102 determines whether the drawing information contains drawing information for a join (S800). If not (that is, there is no join) (No at S800), the engine control unit 102 controls the mounting table 110 and the head 130 to perform conventional the image forming process on a three-dimensional object mounted on the mounting table 110 on the basis of the drawing information (S801), and ends the process.

Figure 9:
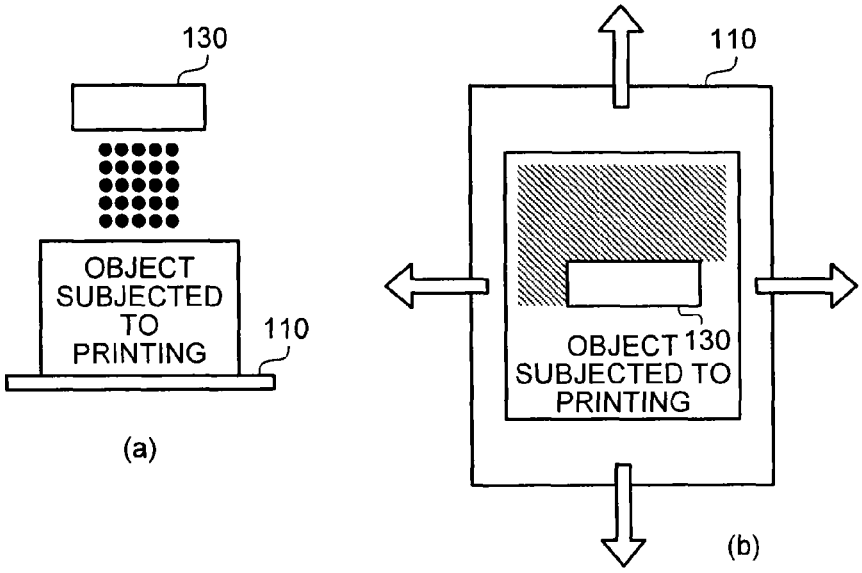
FIG. 9 illustrates how the head according to the embodiment performs an image forming process on a surface of the three-dimensional object.

If the drawing information contains drawing information for a join (Yes at S800), the engine control unit 102 controls the mounting table 110 and the head 130 to perform the image forming process on surfaces of the three-dimensional object on the basis of drawing information for surfaces containing image information partially cut as described above (S802). As illustrated in (a) of FIG. 9, for example, the engine control unit 102 moves the mounting table 110 so that the head 130 and a surface on which the image forming process is performed are positioned parallel to each other. As illustrated in (b) of FIG. 9, the engine control unit 102 causes the head 130 to eject ink and moves the mounting table 110 back and forth and left and right to perform the image forming process on the surface excluding an end portion (edge) of the surface.

Figure 10:
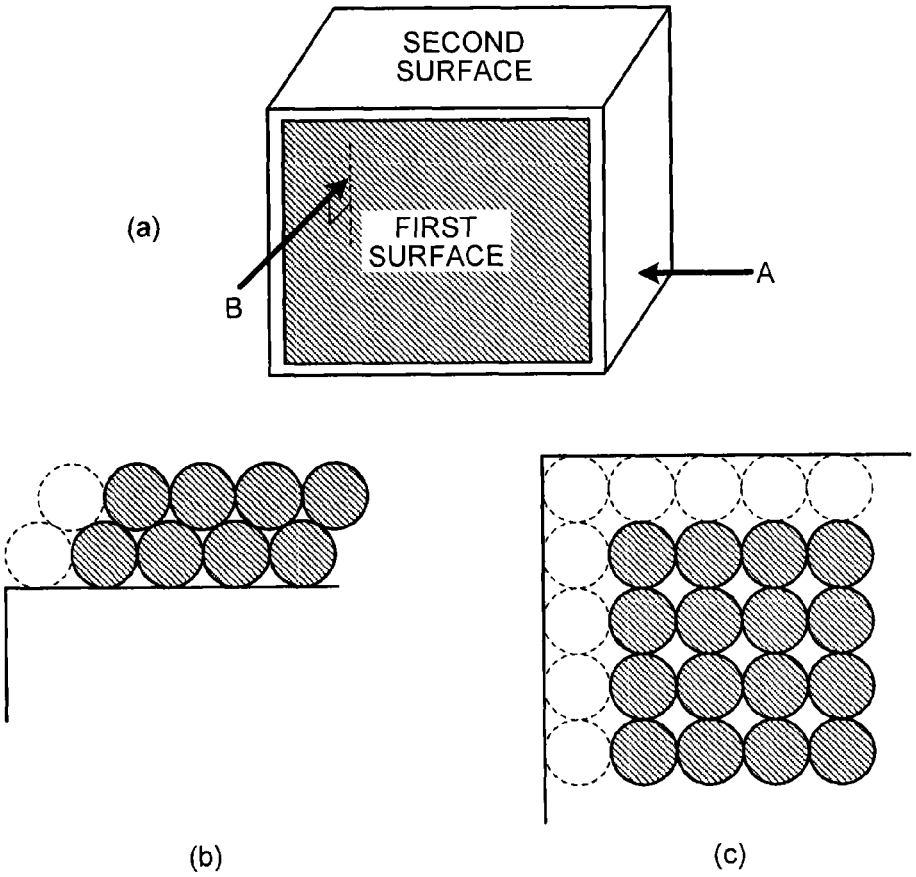
FIG. 10 illustrates how the image forming process is performed on a surface of the three-dimensional object according to the embodiment.

In FIG. 10, (a) is a diagram illustrating an example of a three-dimensional object that has a first surface on which the image forming process is performed except for an end portion thereof. In FIG. 10, (b) is an enlarged diagram illustrating the first surface of the three-dimensional object seen from the direction indicated by A in (a) of FIG. 10. In FIG. 10, (c) is an enlarged diagram illustrating the first surface of the three-dimensional object seen from the direction indicated by B in (a) of FIG. 10, that is, from the direction perpendicular to the first surface. As illustrated in (b) and (c) of FIG. 10, when a surface has a join, the image forming process described above is performed such that ink is applied to the surface leaving a space from an end portion of the surface by one dot of ink droplets. It is sufficient to leave a space of one dot because, in a normal operation, ink does not drip out over a space of one dot. A space left from an end portion of a surface is not limited to one dot, but may be a space of equal to or larger than two dots.

Figure 11:
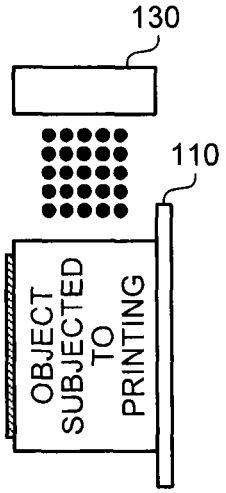
FIG. 11 is a diagram illustrating how the head according to the embodiment performs the image forming process on a surface of the three-dimensional object.

After performing the image forming process on one surface, the engine control unit 102 determines whether the image forming process has been completed on all the surfaces (S803). If not (No at S803), the engine control unit 102 performs the image forming process on a surface on which the image forming process has not been completed (S802). The engine control unit 102, for example, controls the mounting table 110 to move from a position illustrated in (a) of FIG. 9 to a position illustrated in FIG. 11 in which the head 130 and another surface of the three-dimensional object are positioned parallel to each other. When the engine control unit 102 moves the mounting table 110, the engine control unit 102 moves the head 130 upwards so as not to contact the mounting table 110. After moving the mounting table 110, the engine control unit 102 then moves the head 130 downwards and upwards to adjust the head 130 to be in a suitable distance from the surface for the image forming process.

Figure 12:
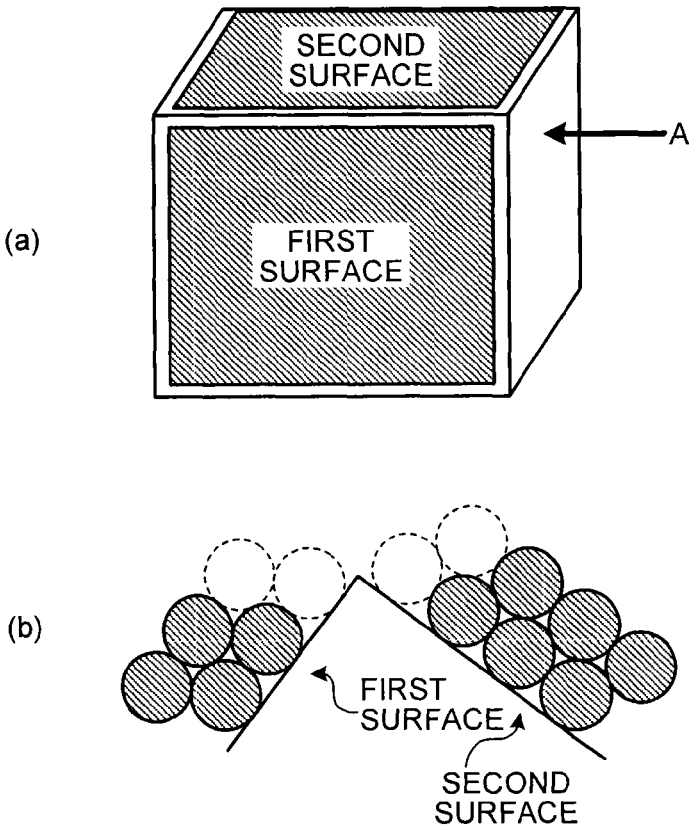
FIG. 12 illustrates how the image forming process is performed on surfaces of the three-dimensional object according to the embodiment.

In FIG. 12, (a) is a diagram illustrating an example of the three-dimensional object that has a second surface, as well as the first surface, on which the image forming process is performed except for an end portion thereof. In FIG. 12, (b) is an enlarged diagram illustrating the first and the second surfaces of the three-dimensional object seen from the direction indicated by A in (a) of FIG. 12. As illustrated in (b) of FIG. 12, ink is applied to the second surface leaving a space from an end portion of the surface by one dot of ink droplets in the same manner as in the image forming process performed on the first surface. By performing such an image forming process described above, ink is not applied to the join between the first and the second surfaces.

Figure 13:
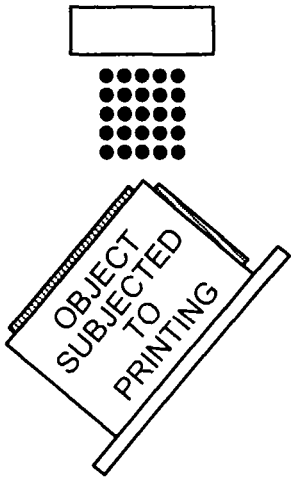
FIG. 13 is a diagram illustrating how the head according to the embodiment performs an image forming process on a join of the three-dimensional object.

The engine control unit 102 repeats such an image forming process described above on surfaces, and if it completes the image forming process on all the surfaces (Yes at S803), the engine control unit 102 controls the mounting table 110 and the head 130 to perform the image forming process on joins (S804). As illustrated in FIG. 13, for example, the engine control unit 102 moves the mounting table 110 so that ink is ejected to a join. For example, the engine control unit 102 moves the mounting table 110 such that a line that halves an angle formed by two surfaces of the three-dimensional object is positioned substantially perpendicular to the nozzle surface. "Substantially perpendicular" means that the difference between 90 degrees and an angle at which the line and the nozzle surface meet is less than a certain threshold.

Figure 14:
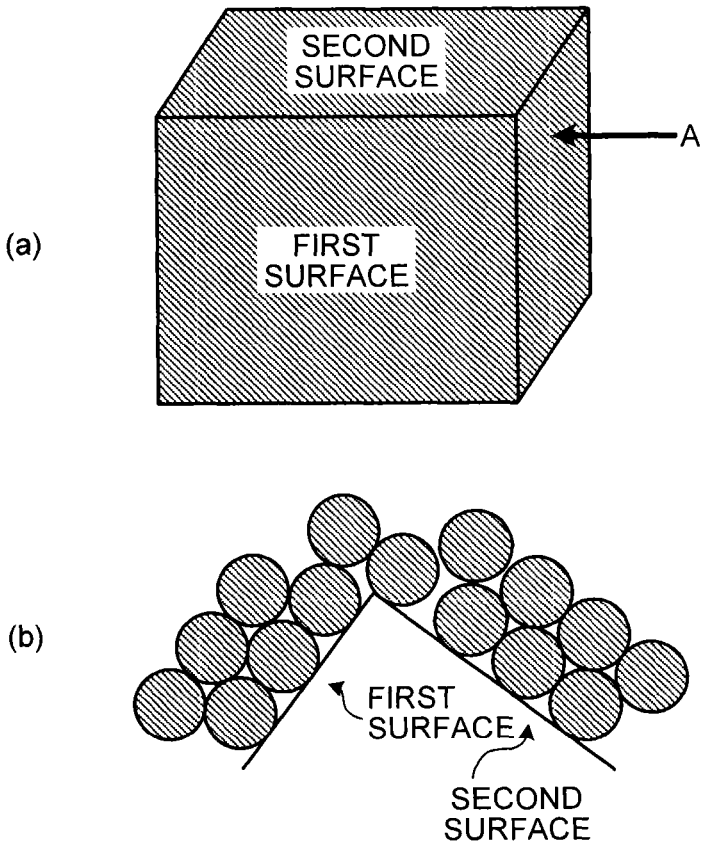
FIG. 14 illustrates how the image forming process is performed on a join of the three-dimensional object according to the embodiment.

In FIG. 14, (a) is a diagram illustrating an example of the three-dimensional object that has joins on which the image forming process is performed. In FIG. 14, (b) is an enlarged diagram illustrating the first and the second surfaces of the three-dimensional object seen from the direction indicated by A in (a) of FIG. 14. As illustrated in (b) of FIG. 14, the image forming process described above is first performed on surfaces, and then performed on a join, whereby ink is applied without causing a blank portion along a join.

Figure 15:
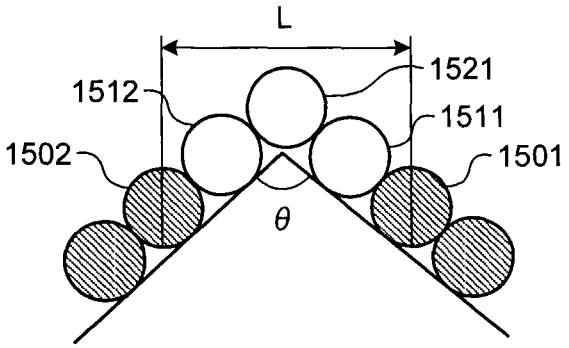
FIG. 15 is a diagram for explaining processing for generating drawing information for a join of the three-dimensional object according to the embodiment.

The drawing information generation unit 164 generates drawing information for a join in accordance with information such as the size of an image that has been cut so as not to cause a blank portion along the join or dribbling of ink. The drawing information generation unit 164 generates drawing information for a join as described below, for example. FIG. 15 is a diagram for explaining generation processing of the drawing information for a join. The drawing information generation unit 164 uses an angle θ formed by two surfaces extracted to obtain a distance L between the center of a dot 1501 and the center of a dot 1502 that are formed on each end of the surfaces. The drawing information generation unit 164 obtains the maximum value of n satisfying, for example, L n to generate drawing information so that n dots are formed on the join. In the example of FIG. 15, the drawing information generation unit 164 generates drawing information so that two dots 1511 and 1512 are formed on the join.

The number of layers of dots to be deposited on a join may be changed depending on parameters such as the number of layers of dots deposited on each surface, the angle 0, and a difference between the sum of widths of n dots and the distance L. FIG. 15 illustrates an example in which a dot 1521 is deposited on the layer containing the dots 1511 and 1512.

The engine control unit 102 determines whether the image forming process described above has been completed on all the joins (S805). If not (No at S805), the engine control unit 102 performs the image forming process on a join on which the image forming process has not been completed. If the image forming process has been completed on all the joins (Yes at S805), the engine control unit 102 ends the process. Although the present embodiment describes a case in which the image forming process on all the surfaces is performed first before the image forming process on joins is performed, the image forming process for all the joins may be performed first before the image forming process for surfaces is performed.

In the present embodiment, as described above, when the image forming process is performed on a three-dimensional object that has joins between surfaces, ink is first applied to the surfaces such that image information partially cut by a predetermined amount from the end of each surface is formed, whereby ink is not applied to the joins and their peripheries. Ink is then applied to the joins. This enables the image forming apparatus according to the present embodiment to apply ink to a join while preventing the ink from dripping out from an edge of a surface, and to prevent a blank portion from occurring along a join without causing dribbling of ink. The image forming apparatus according to the present embodiment applies ink to a join to which and to the periphery of which ink has not been applied. This can prevent dribbling of ink, which occurs due to excessive ink on the join, when ink is applied to the join.

Figure 16:
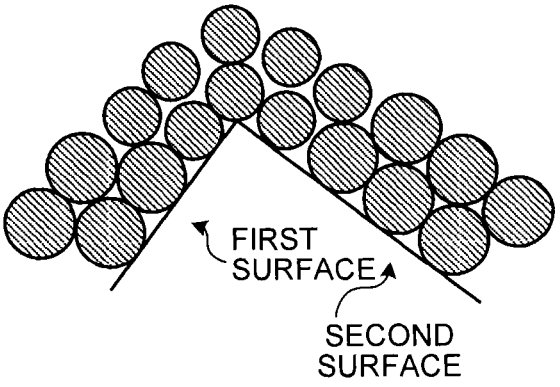
FIG. 16 is a diagram illustrating how the image forming process is performed on a join of the three-dimensional object according to the embodiment.

The present embodiment describes a case in which, when performing the image forming process on a join, the image forming apparatus uses the same size of ink droplets as that of ink droplets adhering to a surface, which is an example. When performing the image forming process on a join, the image forming apparatus may use a smaller size of ink droplets than that of ink droplets used in the image forming process for a surface as illustrated in FIG. 16. This enables the image forming apparatus to fill with finer ink droplets an edge portion between surfaces to which ink droplets are difficult to adhere compared to a plane surface, thereby enabling a high-quality image forming process. The image forming apparatus may, for example, adjust concentration of ink droplets per dot (ink droplets for surfaces have normal concentration, and those for end portions have low concentration) on performing the image forming process. When the image forming apparatus ejects different colors of ink to two surfaces, for example, the image forming apparatus may decrease ink concentration of each color so that the colors mixed on the join will not be conspicuous.

Figure 17:
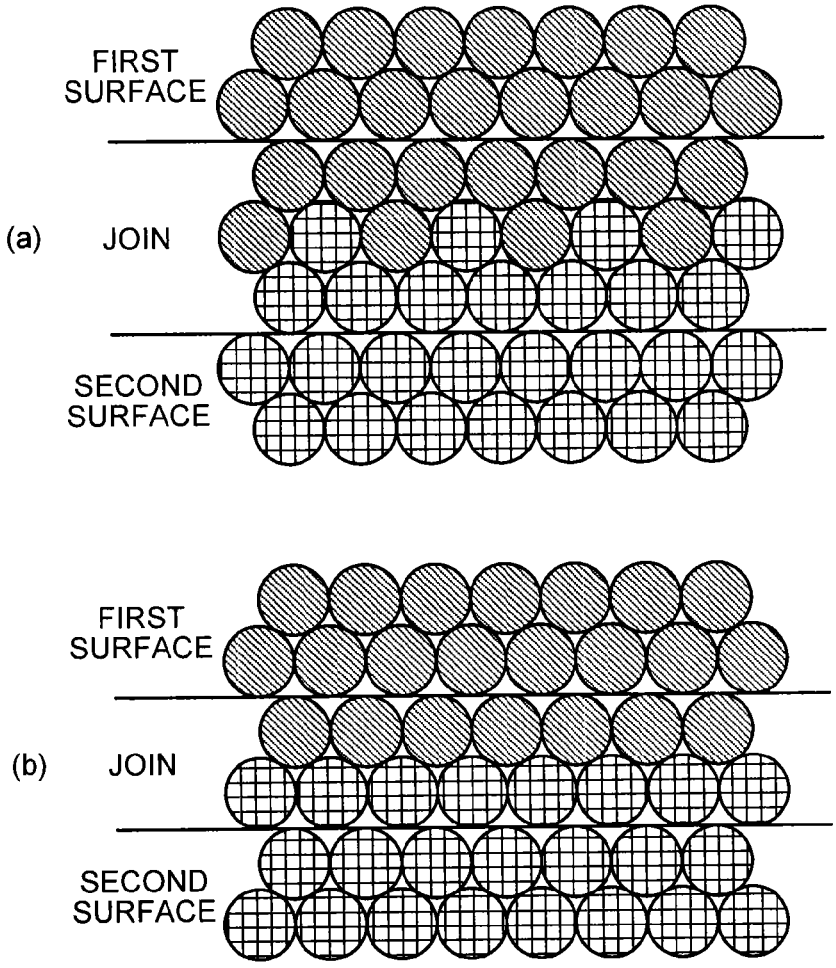
FIG. 17 illustrates how ink droplets are arranged along a join of the three-dimensional object according to the embodiment.

When the image forming process is performed on surfaces forming a join on the basis of different image information (such as image information each containing a different color), the drawing information generation unit 164 generates drawing information for a join as follows. In FIG. 17, (a) illustrates an arrangement of ink droplets in a join between the first and the second surfaces in which ink droplets are arranged in rows of three (odd number). In FIG. 17, (b) illustrates an arrangement of ink droplets in a join between the first and the second surfaces in which ink droplets are arranged in rows of two (even number).

As illustrated in (a) of FIG. 17, when ink is applied to the join with ink droplets arranged in rows of an odd number, the drawing information generation unit 164 generates drawing information containing image data (represented by hatched ink droplets in (a) of FIG. 17) of one surface and image data (represented by ink droplets with a checked pattern in (a) of FIG. 17) of the other surface that are alternately arranged in the center row of the rows of an odd number. The number of dots of each image data alternately arranged in the center row is not limited to one as illustrated in (a) of FIG. 17, but may be equal to or larger than two.

The drawing information generation unit 164 generates drawing information for the rows other than the center row such that image data of a nearer surface is formed on the rows (in (a) of FIG. 17, image data of the first surface is formed on the row above the center row, and image data of the second surface is formed on the row below the center row) as illustrated in (a) of FIG. 17. The image forming apparatus performs such processing by controlling presence or absence of ink droplets dot by dot, and also by adjusting output concentration of ink droplets (in (a) of FIG. 17, for example, ink droplets in the rows above and below the center row of the join have a normal concentration, and ink droplets in the center row have a lower concentration).

When ink is applied to the join with ink droplets arranged in rows of an even number, the drawing information generation unit 164 generates drawing information containing image data of a surface and image data of the other surface that are disposed in a staggered arrangement in the two rows in the center of the join as illustrated in (b) of FIG. 17. The drawing information generation unit 164 generates drawing information for the rows other than the center rows of the join such that image data of a nearer surface is formed on the rows.

The processing described above can create subtle gradations on the join when different image information is formed on each surface forming the join. When ink is applied to a join with ink droplets arranged in rows of an odd number, the drawing information generation unit 164 may generate drawing information that contains image data of two surfaces alternately arranged not only along the center row of the join but along a predetermined number of rows above and below the center row. The drawing information generation unit 164 may generate drawing information that contains an equal proportion of image data of two surfaces alternately arranged in rows of the join, and may also generate drawing information in which a higher proportion of image data of a surface is contained in a row that is closer to the surface.

As more numbers of ink droplets vertically adhere to a surface, the coating of the surface becomes thicker. When the image forming process is performed on a join, the engine control unit 102 controls the head 130 to change the number of ink droplets adhering to the join according to the number of ink droplets vertically adhering to the surfaces so that the coating of the join and the coating of the surfaces have the same thickness. This can prevent unevenness between the surfaces and the join due to the coating.

Although, in the embodiment described above, the drawing information generation unit 164 generates drawing information for a surface containing image information partially cut by one dot of ink droplets from an end of a surface, a larger number of dots may be cut from the end of the surface in accordance with, for example, fluctuations in landing positions of ink droplets on the surface and the size of ink droplets.

In the embodiment described above, the surface information extraction unit 163 extracts surface information on the basis of an interior angle between surfaces extracted. In addition to this, the surface information extraction unit 163 may extracts surface information in consideration of a deviation between a nozzle position of the head 130 from which ink is ejected and a position on a surface to which the ink ejected from the head 130 actually adheres.

Figure 18:
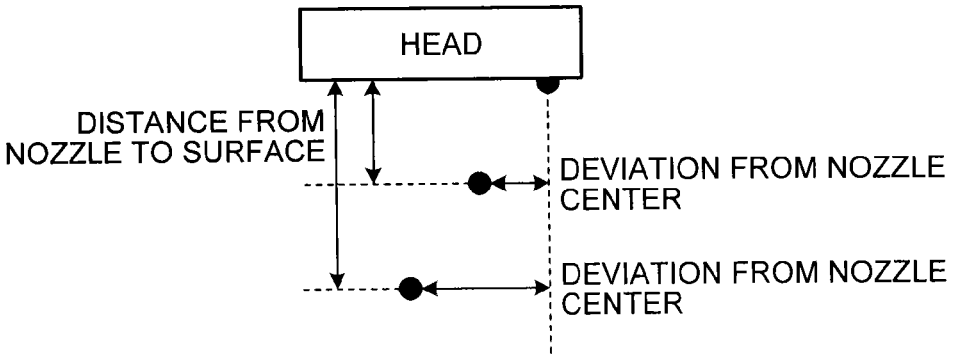
FIG. 18 is a diagram illustrating a deviation between a position of a nozzle of the head according to the embodiment and a position to which an ink droplet actually adheres.

FIG. 18 is a diagram illustrating an example of a deviation between a nozzle position of the head 130 from which ink is ejected and a position on a surface to which an ejected ink droplet actually adheres. As illustrated in FIG. 18, the deviation between an adhering position of ink and the nozzle position increases as the vertical distance between the nozzle from which ink is ejected and the surface increases. When surfaces are processed as one surface because an interior angle between the surfaces is larger than a predetermined angle, ink may adhere to a position significantly deviating from a position to which ink should adhere depending on the vertical distance between the nozzle and the surfaces, whereby ink may drip out from a surface to which the ink should be applied and may cause dribbling of ink.

Figure 19:
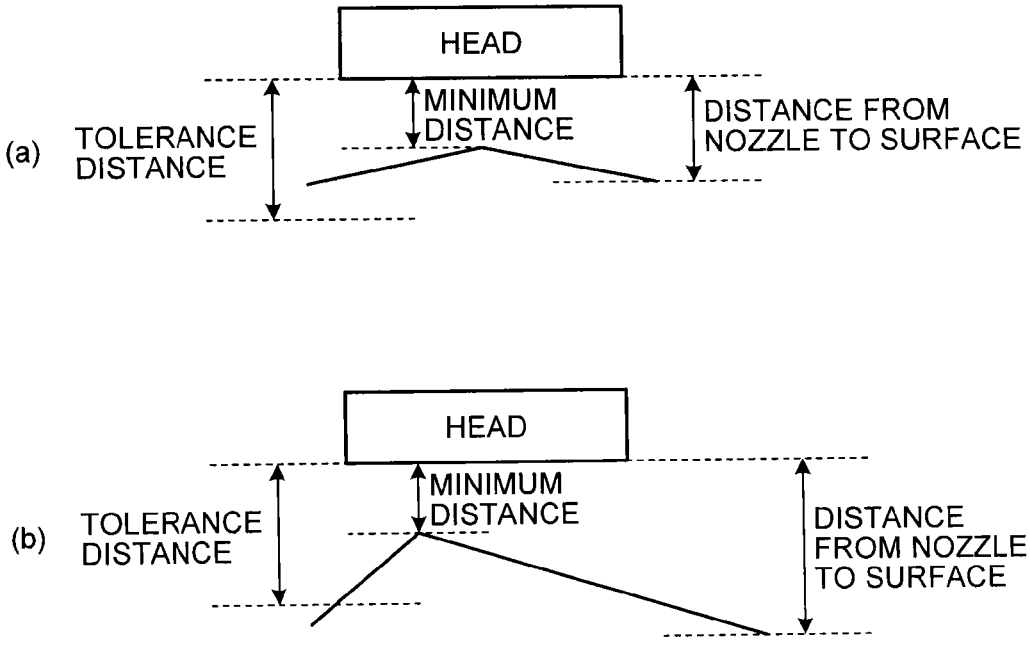
FIG. 19 illustrates how surface information extraction processing is performed on the basis of a distance from the nozzle of the head according to the embodiment to a surface.

Even when an interior angle between surfaces is larger than a predetermined angle, the surface information extraction unit 163 extracts these surfaces as different surfaces so that the image forming process is performed on each surface, depending on the vertical distance between the nozzle of the head 130 and a surface constituted of the surfaces if the surfaces are considered to be one surface. FIG. 19 illustrates an example of how surface information extraction processing is performed on the basis of a distance between the nozzle and a surface. When an interior angle between surfaces is larger than a predetermined angle, these surfaces are assumed to be one surface. The surface gently slopes in this case.

As illustrated in (a) of FIG. 19, when the longest distance of vertical distances between the nozzle surface of the head 130 and the surface is shorter than a predetermined tolerance distance, the surface information extraction unit 163 determines that the maximum deviation in the ink adhering position is within a tolerance limit when the image forming process is performed on the surface, and extracts the surface as one piece of surface information.

As illustrated in (b) of FIG. 19, when the longest distance of vertical distances between the nozzle surface of the head 130 and the surface is longer than a predetermined tolerance distance, the surface information extraction unit 163 determines that, when the image forming process is performed on the surface, the ink adhering position will excessively deviate, and extracts the surface as different pieces of surface information, not one piece of surface information, on which the image forming process is performed separately.

This can prevent a blank portion from occurring along a join without causing dribbling of ink caused by a deviation between the nozzle position of the head 130 and a position to which ink ejected from the nozzle actually adheres. The surface information extraction unit 163 applies the processing described above to a curved surface of a three-dimensional object (such as a cylinder), so that it extracts an area within the tolerance distance as a piece of surface information. This can prevent dribbling of ink from occurring when the image forming process is performed on a three-dimensional object having a curved surface.

Modification

Figure 20:
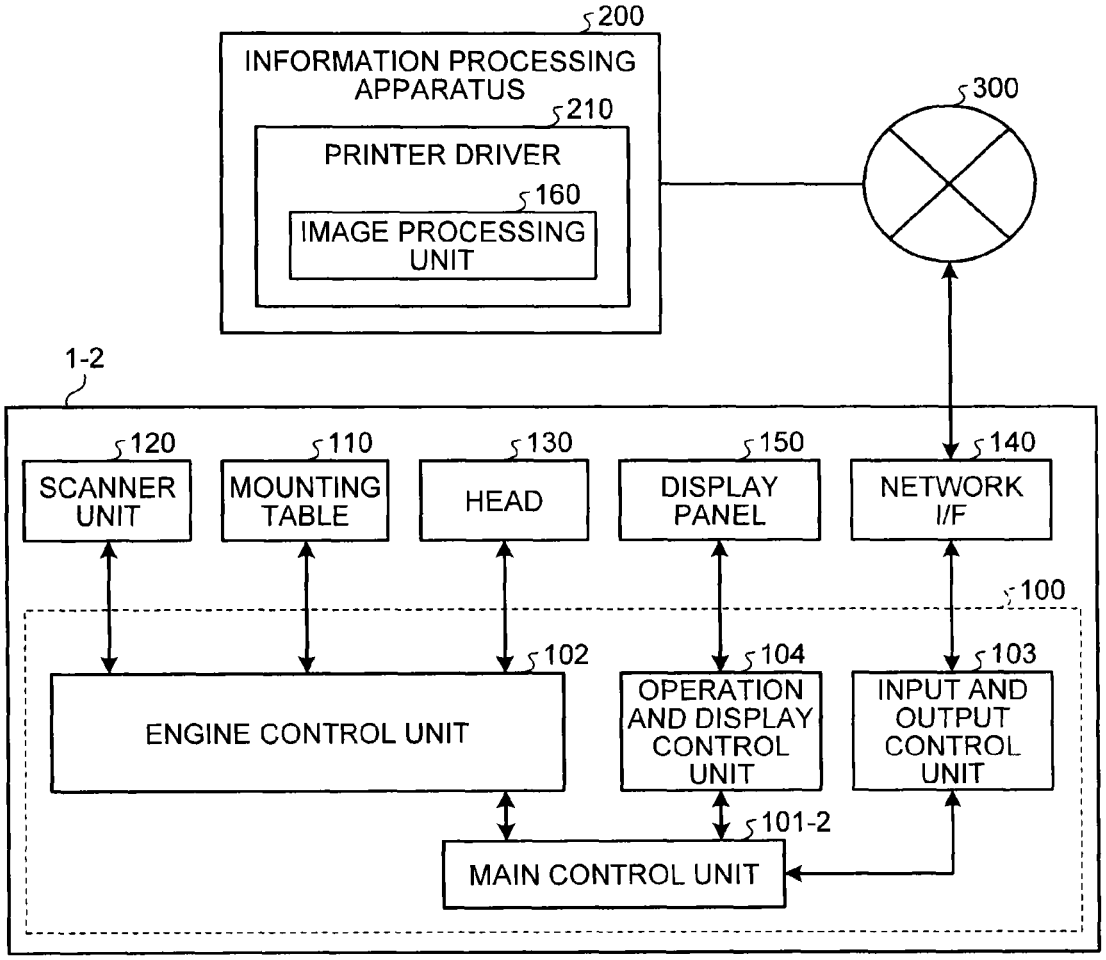
FIG. 20 is a block diagram illustrating an example of a functional configuration of an image forming system according to a modification.

In the embodiment described above, drawing information based on information such as print information is generated by the image forming apparatus 1 (image processing unit 160). The drawing information may be generated by other information processing apparatuses connected to the image forming apparatus 1. For example, the same function as that of the image processing unit 160 may be provided for a printer driver installed on an information processing apparatus such as a PC. FIG. 20 is a block diagram illustrating an example of a functional configuration of an image forming system according to a modification of the present embodiment configured as described above.

As illustrated in FIG. 20, the image forming system is configured by an information processing apparatus 200 and an image forming apparatus 1-2 that are connected via a network 300.

The information processing apparatus 200 is a PC including a control device such as a CPU, a storage device such as a ROM and a RAM, an external storage device such as an HDD and a CD drive, a display device such as a display, and an input device such as a keyboard and a mouse. The information processing apparatus 200 includes a printer driver 210. The information processing apparatus 200 also includes, for example, an application that creates documents to be printed, but it is not illustrated in FIG. 20.

The printer driver 210 includes the same image processing unit 160 as that described in the embodiment above. The printer driver 210 transmits a print job containing drawing information generated to the image forming apparatus 1-2 and requests the image forming apparatus 1-2 to perform the image forming process in accordance with the print job. A main control unit 101-2 of the image forming apparatus 1-2 controls the engine control unit 102 to perform the image forming process in accordance with the drawing information contained in the print job as requested by the printer driver 210.

A configuration unit (such as the drawing information generation unit 164) that generates drawing information is not necessarily included in the image forming apparatus, but may be included in an external apparatus such as the information processing apparatus. This configuration can also prevent dribbling of ink even when the image forming process is performed on a three-dimensional object having a curved surface as in the case of the embodiment described above.

According to the embodiment, a blank portion along a join between surfaces of a three-dimensional object can be prevented without causing dribbling of ink.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a shape information acquirer configured to acquire shape information indicating a shape of a three-dimensional object on which an image forming process is to be performed;

a surface determiner configured to determine a plurality of surfaces from which the three-dimensional object is constructed, based on the shape information; and an output image information generator configured to generate surface image information and join region image information, the surface image information being information on images to be formed on respective surfaces, each image being of a region obtained by cutting an end of a corresponding surface by a predetermined amount, the join region image information being information on an image to be formed on a join region between adjacent surfaces, wherein the surface determiner is configured to determine that the adjacent surfaces of the three-dimensional object are different surfaces when an angle formed between the adjacent surfaces of the three-dimensional object is equal to or smaller than a predetermined angle.

2. The image forming apparatus according to claim 1, wherein the output image information generator is configured to generate, as the join region image information, image information in which first image information for a first surface out of the plurality of surfaces and second image information for a second surface adjacent to the first surface are arranged in a predetermined order, the first image information and the second image information being different from each other.

3. The image forming apparatus according to claim 1, wherein the surface determiner is configured to determine that two adjacent surfaces forming an angle larger than the predetermined angle are the different surfaces when a distance between each of the two adjacent surfaces and a droplet ejecter that ejects droplets to perform image formation is longer than a tolerance distance.

4. The image forming apparatus according to claim 3, further comprising an image forming controller configured to cause the droplet ejecter to perform the image forming process.

5. The image forming apparatus according to claim 4, wherein the image forming controller is configured to control the droplet ejecter to eject a smaller size of droplets to the join region than a size of droplets ejected to each surface.

6. The image forming apparatus according to claim 4, wherein the image forming controller is configured to cause the droplet ejecter to perform the image forming process on the join region based on the join region image information after causing the droplet ejecter to perform the image forming process on each surface based on the surface image information.

7. The image forming apparatus according to claim 4, wherein the image forming controller is configured to control the droplet ejecter to adjust an amount of droplets ejected to the join region in accordance with a thickness of coating formed on each surface with droplets ejected to the each surface.

8. The image forming apparatus according to claim 1, wherein the output image information generator is configured to generate the surface image information and the join region image information based on drawing information contained in a print job.

9. An image forming method comprising:

acquiring shape information indicating a shape of a three-dimensional object on which an image forming process is to be performed;

determining a plurality of surfaces from which the three-dimensional object is constructed, based on the shape information;

generating surface image information and join region image information, the surface image information being information on images to be formed on respective surfaces, each image being of a region obtained by cutting an end of a corresponding surface by a predetermined amount, the join region image information being information on an image to be formed on a join region between adjacent surfaces; and determining that the adjacent surfaces of the three-dimensional object are different surfaces when an angle formed between the adjacent surfaces of the three-dimensional object is equal to or smaller than a predetermined angle.

10. A non-transitory computer-readable storage medium with an executable program stored thereon and executed by a computer, wherein the program instructs the computer to perform:

acquiring shape information indicating a shape of a three-dimensional object on which an image forming process is to be performed;

determining a plurality of surfaces from which the three-dimensional object is constructed, based on the shape information;

generating surface image information and join region image information, the surface image information being information on images to be formed on respective surfaces, each image being of a region obtained by cutting an end of a corresponding surface by a predetermined amount, the join region image information being information on an image to be formed on a join region between adjacent surfaces; and determining that the adjacent surfaces of the three-dimensional object are different surfaces when an angle formed between the adjacent surfaces of the three-dimensional object is equal to or smaller than a predetermined angle.

* * * * *